US010227751B2

(12) United States Patent
Nero et al.

(10) Patent No.: US 10,227,751 B2
(45) Date of Patent: Mar. 12, 2019

(54) SECTIONAL PLOW

(71) Applicant: WJN Enterprises, Inc., Tinley Park, IL (US)

(72) Inventors: Bill Nero, Tinley Park, IL (US); Kurt Ende, Manhattan, IL (US)

(73) Assignee: WJN Enterprises, Inc., Tinley Park, IL (US)

( * ) Notice: Subject to any disclaimer, the term of this patent is extended or adjusted under 35 U.S.C. 154(b) by 0 days.

(21) Appl. No.: 14/844,793

(22) Filed: Sep. 3, 2015

(65) Prior Publication Data

US 2016/0208456 A1 Jul. 21, 2016

Related U.S. Application Data

(60) Provisional application No. 62/103,797, filed on Jan. 15, 2015.

(51) Int. Cl.
*E02F 3/815* (2006.01)
*E01H 5/06* (2006.01)

(52) U.S. Cl.
CPC ..... *E02F 3/8152* (2013.01); *E01H 5/06* (2013.01); *E01H 5/061* (2013.01); *E02F 3/8157* (2013.01)

(58) Field of Classification Search
CPC ..... E01H 5/061; E01H 5/067; E02F 3/8152; E02F 3/8157
USPC ..... 37/270, 274, 281
See application file for complete search history.

(56) References Cited

U.S. PATENT DOCUMENTS 1,550,574 A * 8/1925 Sargent ..... E01H 5/067 37/271
2,387,686 A * 10/1945 Shean et al. ..... E01H 5/067 37/279
3,034,237 A * 5/1962 Wolfe ..... E02F 3/769 37/241
3,484,963 A * 12/1969 Munson ..... E01H 5/04 198/642
4,073,077 A * 2/1978 Essel ..... E01H 5/065 172/777
4,275,514 A * 6/1981 Maura ..... E01H 5/065 37/281

(Continued)

OTHER PUBLICATIONS

"UTV Plows, ATV Plows and UTV/ATV Snowplow Accessories." page from BOSS Snowplow "UTV/ATV Plows 2015" brochure; copyright 2015 Boss Products; 1 page.

*Primary Examiner* — Thomas B Will
*Assistant Examiner* — Joan D Misa
(74) *Attorney, Agent, or Firm* — Emerson Thomson Bennett; Roger D. Emerson; Nicholas J. Bagnolo

(57) ABSTRACT

A sectional plow is provided. The sectional plow includes a plow body or blade. It also includes a first side plate attachable to a first side of the plow body, and a second side plate attachable to a second opposite side of the plow body. The sectional plow also includes a first thrust arm attachable to the plow body and the first side plate, and a second thrust arm attachable to the plow body and the second side plate. In an embodiment, the thrust arm is a pair of thrust arms. The plow also includes extensions of different sizes that are insertable between the plow body and the side plates to extend the width of the plow and provide at least three alternative plow widths. Significantly, the plow can be easily assembled and disassembled. It is designed to be bolted together as opposed to welded together.

17 Claims, 15 Drawing Sheets

(56) References Cited

U.S. PATENT DOCUMENTS 4,346,528 A * 8/1982 Shwayder ..... E01H 5/066 37/270
4,356,645 A * 11/1982 Hine ..... E01H 5/06 172/815
4,479,312 A * 10/1984 Turgeon ..... E01H 4/02 172/815
4,707,936 A * 11/1987 Steinhoff ..... E01H 5/065 37/264
4,723,609 A * 2/1988 Curtis ..... E02F 3/815 15/245
4,741,116 A * 5/1988 Engle ..... E01H 5/065 172/701.1
4,936,392 A * 6/1990 Kitchin ..... E02F 3/962 172/815
5,241,763 A * 9/1993 Dynan ..... E02F 3/962 37/407
5,285,588 A * 2/1994 Niemela ..... E01H 5/065 37/232
5,392,538 A * 2/1995 Geerligs ..... E01H 5/061 37/236
5,599,135 A * 2/1997 Delaurenti ..... E01C 19/187 172/815
5,724,755 A * 3/1998 Weagley ..... E01H 5/06 37/231
5,894,689 A * 4/1999 Turk ..... E02F 3/815 37/280
6,094,846 A * 8/2000 Feller ..... B60B 33/0002 16/35 D
6,112,438 A * 9/2000 Weagley ..... E01H 5/065 172/393
6,298,585 B1 * 10/2001 Boulet ..... E01H 5/066 172/817
6,363,631 B1 * 4/2002 Cordingley ..... E01H 5/066 37/280
6,425,196 B1 * 7/2002 Weagley ..... E01H 5/065 172/393
6,612,050 B2 * 9/2003 Takeuchi ..... E01H 5/061 37/232
D511,173 S * 11/2005 Fatemi ..... D15/11
D511,174 S * 11/2005 Fatemi ..... D15/11
D512,443 S * 12/2005 Fatemi ..... D15/11
7,481,011 B2 * 1/2009 Nesseth ..... E01H 5/066 172/815
7,578,078 B2 * 8/2009 Gandolfi ..... E01H 5/066 172/815
7,588,092 B2 * 9/2009 Liebl ..... E02F 3/8157 172/811
7,681,337 B2 * 3/2010 Watson ..... E01H 5/065 37/274
7,735,245 B2 * 6/2010 Schmeichel ..... E01H 5/06 172/811
7,743,536 B2 * 6/2010 Evans ..... E01H 5/06 172/273
7,805,863 B2 * 10/2010 Vennard ..... E01H 5/066 172/815
7,941,947 B2 * 5/2011 Stephan ..... E01H 5/06 172/273
8,191,288 B2 * 6/2012 Weagley ..... E01H 5/06 172/702
D684,601 S * 6/2013 Robb, Jr. ..... D15/11
8,887,413 B2 * 11/2014 Miller ..... E02F 3/8155 37/279
9,151,006 B2 * 10/2015 Guggino ..... E02F 3/962
9,243,376 B2 * 1/2016 Guggino ..... E01H 5/066
2005/0126051 A1 * 6/2005 Fatemi ..... E01H 5/066 37/266
2007/0089327 A1 * 4/2007 Watson ..... E01H 5/065 37/281
2007/0169384 A1 * 7/2007 Stephan ..... E01H 5/06 37/281
2016/0010314 A1 * 1/2016 Kassander ..... E02F 3/8152 37/453
2016/0069032 A1 * 3/2016 Winter ..... E01H 5/061 37/270

* cited by examiner

SECTIONAL PLOW

CROSS-REFERENCE TO RELATED APPLICATIONS

The present application claims the benefit of U.S. Provisional Application No. 62/103,797 filed Jan. 15, 2015, the contents of which are incorporated herein by reference.

FEDERALLY SPONSORED RESEARCH OR DEVELOPMENT

N/A

TECHNICAL FIELD

The present invention generally relates to plows such as for snow removal, earth moving or other similar uses, and in particular to a sectional plow that can be assembled and disassembled, thus saving on costs associated with transporting, storing, and repairing the plow.

BACKGROUND OF THE INVENTION

Plows for snow removal from roadways and for moving earth on construction vehicles are well-known in the art. Current plows are generally made of a single piece of material, such as steel, with components welded thereon. The plows are frequently connected to preexisting vehicles. Plows for snow and ice removal or earth moving need to be wide to allow full coverage of a road lane, runway or other open area and to maximize the plow's coverage. Such plows are produced in a single size and welded together at the factory. Different size blades are made separately and shipped separately. The size and bulk of the plows result in increased shipping costs as the plows typically must be shipped on an open flatbed. Each plow often must be packed separately or carefully laid-out on a pallet or in a container for shipping. In addition, the plow's size and bulk requires a large storage space when not in use. Thus, a significant amount of space is needed at the user's facility, the distributor's facility, and the retailer's facility when selling (inventorying) or storing when not in use. Floor space can, of course, be expensive. Because of the size and weight of steel plows, it is often difficult to store them on shelving or store them vertically.

In addition, most plows are sold in single sizes. There are some plows that have hydraulics associated with expanding or reducing their widths, but as a general rule they are made, sold, and used in single sizes. If one size is used and another size desired, the one size is removed from the vehicle and another sized plow is installed in its place. Again, apart from the costs of the separate plows, the time needed to change out one and change in another can also be considerable.

Finally, when a typical plow is damaged, a lot of time and energy must be placed into repairing the plow. Specifically, the damaged components must be cut from the plow such as by special saws and/or saw blades, or by laser/plasma cutting. Once the piece is cut-off, the new piece must be sized and welded into place. This process can take from days to weeks as the replacement parts, if available, must be ordered, received, and fitted, before welding into place.

The present invention provides an easily assembled and disassembled sectional plow that is fastened together when needed. This sectional design permits the plow to be broken down for shipping and storage, resulting in a cost and space savings as compared to a single piece plow. It also allows the sectional pieces to be stacked during shipping and for storage, resulting in reduced shipping and storage space and costs.

Further, it can be easily repaired when a component breaks and must be replaced. Spare parts or components can be stored or easily shipped. Once received, the replacement piece can be bolted on.

Unlike existing plows, the present plow is designed so that it can be bolted together and can be flexible regarding its size or width and can be sized appropriately. It can be made with a width of 8' and easily enlarged to widths such as, but not limited to, 10' and 12' depending on desired use or vehicle. Accordingly, a single plow can be modular and easily extendable by purchase and assembly of relatively few additional parts/components.

SUMMARY OF THE INVENTION

In an embodiment of the present invention, a plow is disclosed that can be assembled and disassembled by removable fasteners (in an alternative embodiment, the separate components of the plow can be secured with other, more permanent fasteners, such as rivets).

The plow includes a blade, two side members, each being positioned at a side of the blade, and at least one or more struts with each reinforcing a side member and the blade. Each side piece has a runner attached to the bottom and an elongated contact edge is attached adjacent the bottom of the blade (again, in alternative embodiments, wheels, a wear surface or other similar structures can be used instead of a runner). The plow is assembled and disassembled by fasteners comprised of sturdy bolts and nuts. In one embodiment, only two struts are used, each strut attaching to the blade and a side member. In another embodiment, two struts are used on each side so that two struts are attached between the blade and each side member. The struts are to reinforce the side members and the blade.

In additional embodiments separate pairs of extensions are used and positioned between the blade and side members, one on each side of the blade. Different pairs of extensions are used to enlarge the width of the plow. A plow of the first embodiment has a width of about 8 feet. Other embodiments have widths of about 10 feet and 12 with dual extensions of approximately 1 foot and 2 feet, respectively. Other widths can be created by altering the number or size of any extensions.

As to the struts or thrust arms, a first thrust arm is attachable to the plow body and the first side plate, and a second thrust arm is attachable to the plow body and the second side plate. When a single thrust arm is used on each side (FIGS. 13 and 14), the first and second thrust arms are attached to the plow body and the first and second side plates at an angle in the range of 30 to 45 degrees along a horizontal axis, and an angle in the range of 50 to 60 degrees along a vertical axis. When dual thrust arms are used, two on each side, as shown in FIGS. 15-20, the first set of thrust arms and second set of thrust arms are attached to the plow body and first and second side plates at an angle in the range of 30 to 60 degrees along a horizontal axis, and an angle in the range of 8 to 16 degrees along a vertical axis.

BRIEF DESCRIPTION OF THE DRAWINGS

To understand the present invention, it will now be described by way of example, with reference to the accompanying drawings in which.

DETAILED DESCRIPTION

Figure 1:
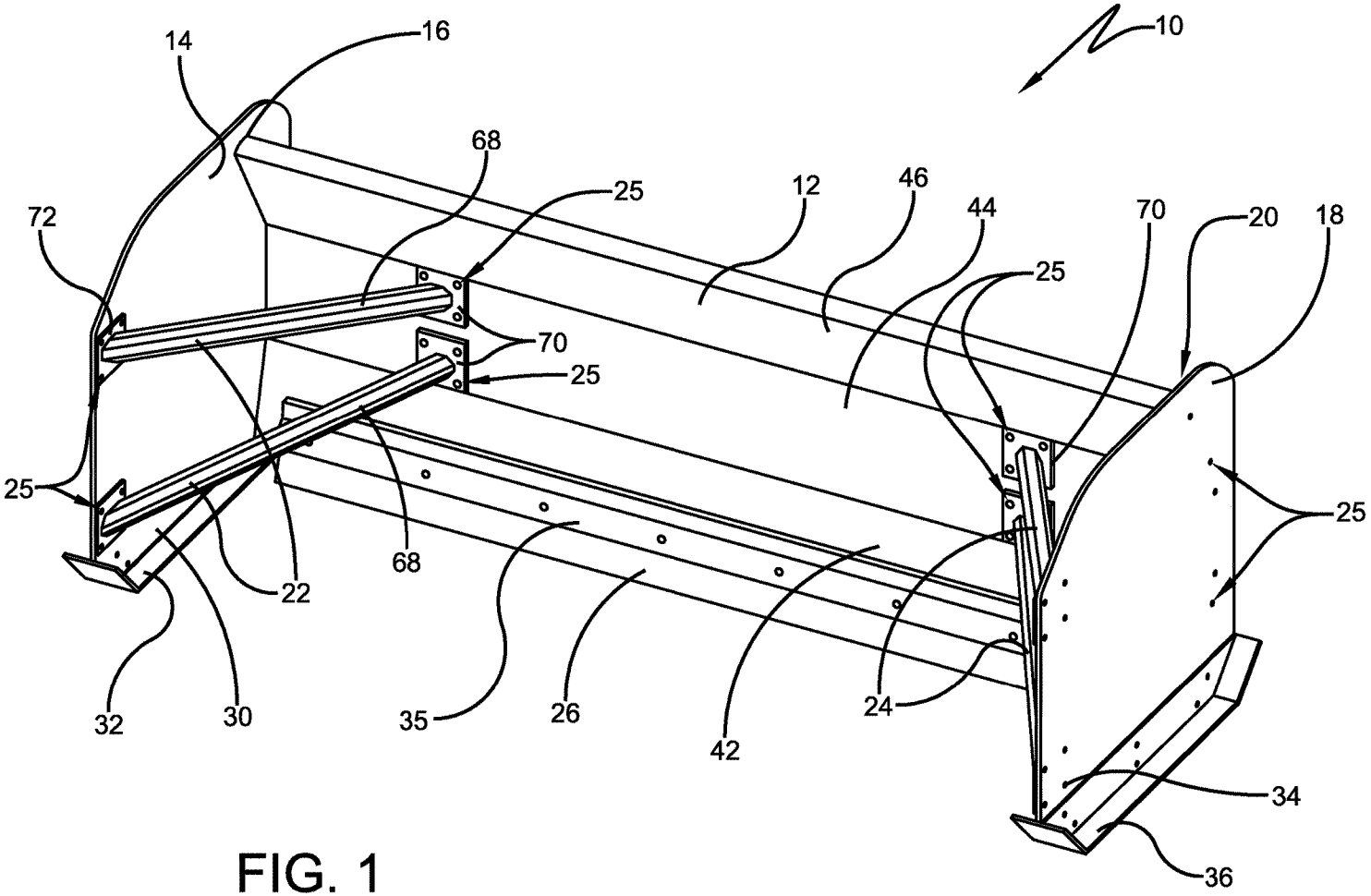
FIG. 1 is a front perspective view of a sectional plow made in accordance with the teachings of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-6 and 15-16 show a first embodiment of a sectional plow 10 made in accordance with the teachings of the present invention. The plow 10 includes a plow body, or blade 12, a first side plate 14 attachable to a first side 16 of the plow body 12. The plow 10 also includes a second side plate 18 attachable to a second side 20 of the plow body 10 opposite the first side plate 14. The first and second side plates 14,18 of the blade 12 include flanges 114,118. (FIG. 4) that project out at right angles to the blade 12. The first and second side plates 14,18 are attached to the flanges 114,118 preferably by high tensile strength bolts 25. (Note: throughout the disclosure reference number 25 is used to show either bolts or openings for the bolts). Very generally, flanges and bolts are used throughout the construction of this plow. The flanges are sized (thickness and width) to support the pieces being connected under strenuous conditions and the bolts are properly spaced from one another for the same purpose. The plow 10 also includes one or more struts or thrust arms. In the embodiment shown, two first struts or thrust arms 22 and two second struts or thrust arms 24 are shown. The first thrust arms 22 are attachable to and extend between the blade or plow body 12 and the first side plate 14. And, the second thrust arms 24 are attachable to the plow body or blade 12 and the second side plate 18. The first and second thrust arms 22,24 are preferably attached to the plow body 12 and respective side plates 14,18 by high tensile strength bolts 25, although any suitable removable attachment or fastening method may be used. The plow body 12, and first and second side plates 14,18 are preferably made of steel, namely stainless steel, but can be any suitable high strength material.

The first and second thrust arms 22,24 each include a bar portion 68. Attached to a first end of the bar portion 68 is a first mounting plate 70. Attached to a second opposite end of the bar portion is a second mounting plate 72. The mounting plates are angled so as to mount flush or at the same angle as the piece (blade or side piece) they are attached to. The first mounting plates 70 include a first plurality of bolt openings 25. Here, there are four. The second mounting plates 72 include a second plurality of bolt openings 25. Here also there are four bolt openings and bolts used. The first and second mounting plates 70,72 are preferably welded to the respective ends of the bar portion 68. The first mounting plates 70 attach to the vertical portion 44 of the plow body 12 using bolts 25 inserted through the bolt openings of the first mounting plates and bolt openings in the generally vertical portion 44 of the plow body 12. The second mounting plates 72 attach to the first and second side plates 14,18 using bolts 25 inserted through bolt openings of the side plates 14,18 and openings of the second mounting plates 72.

Accordingly, when disassembled, the four bars 68 with their mounting plates 70,72 are separated from the blade and side members and can be stored or shipped alongside or in the blade and side members and then be easily reassembled at a later date.

The bottom edge 28 of the blade 12 also includes a contact edge 26 attachable thereto.

Attached to a bottom edge 30 of the first side plate 14 is a first runner 32. Attached to a bottom edge 34 of the second side plate 18 is a second runner 36. Each runner 32,36 also has a flange 32*a*,36*a* for attaching the runner to the bottom edge 30 of the side member. The contact edge 26 and first and second runners 32,36 are attached preferably with high tension bolts 25. The contact edge 26 and first and second runners 32,36 are preferably made of 2000-2500 psi rubber or polyurethane as they are typically in contact with the surface being plowed. The contact edge 26 and bottom edge 28 of the blade 12 can be sandwiched between two elongated straight pieces of steel 35 with bolts going through the pieces of steel and the bottom edge with the contact edge disposed therebetween. The bolt holes of the three pieces are aligned before bolting. In the alternative, the contact edge 26 can be sandwiched between a single elongated piece of steel 35 and the blade 12 with the bolt holes also aligned.

Figure 2:
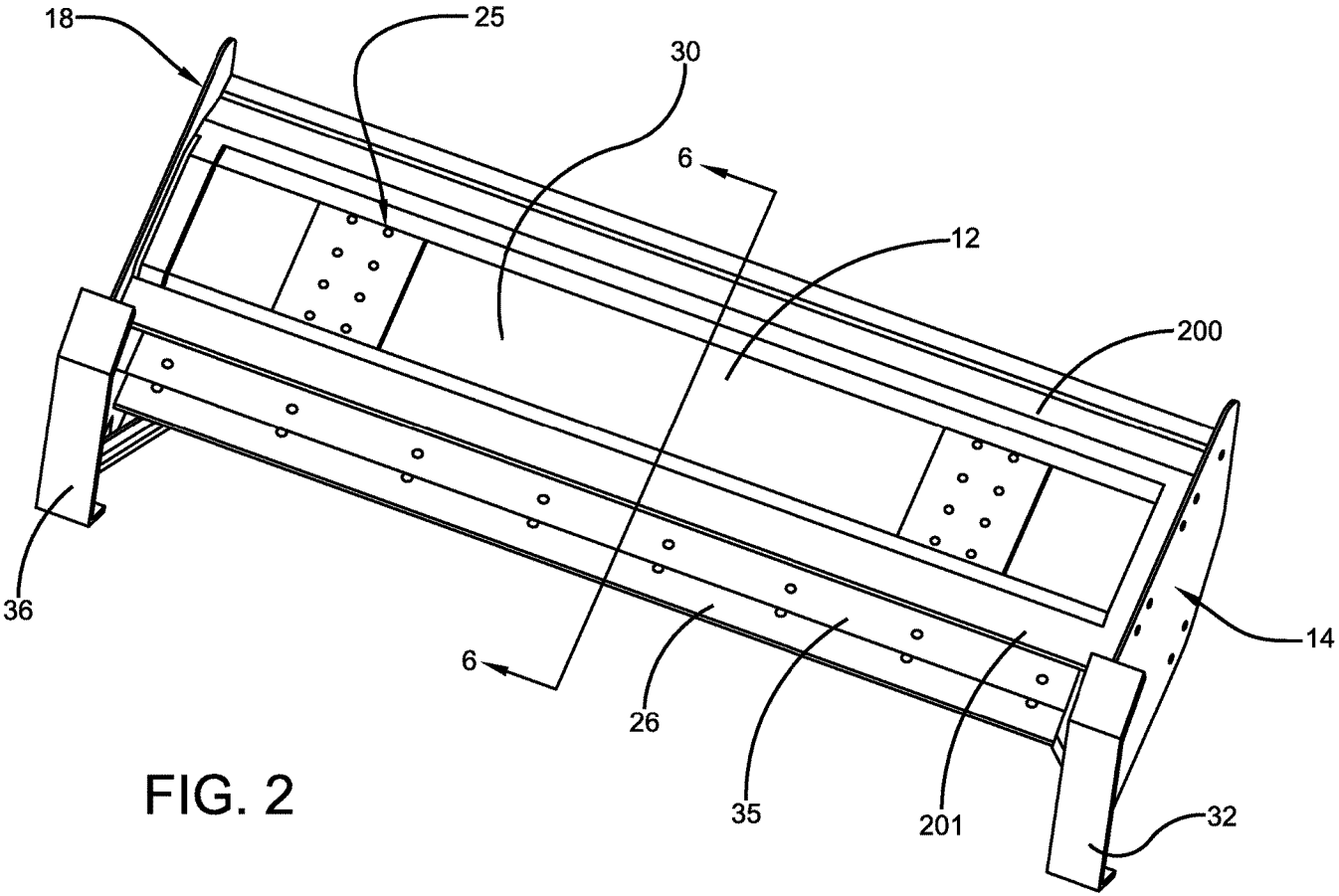
FIG. 2 is a rear perspective view the sectional plow of FIG. 1.
Figure 3:
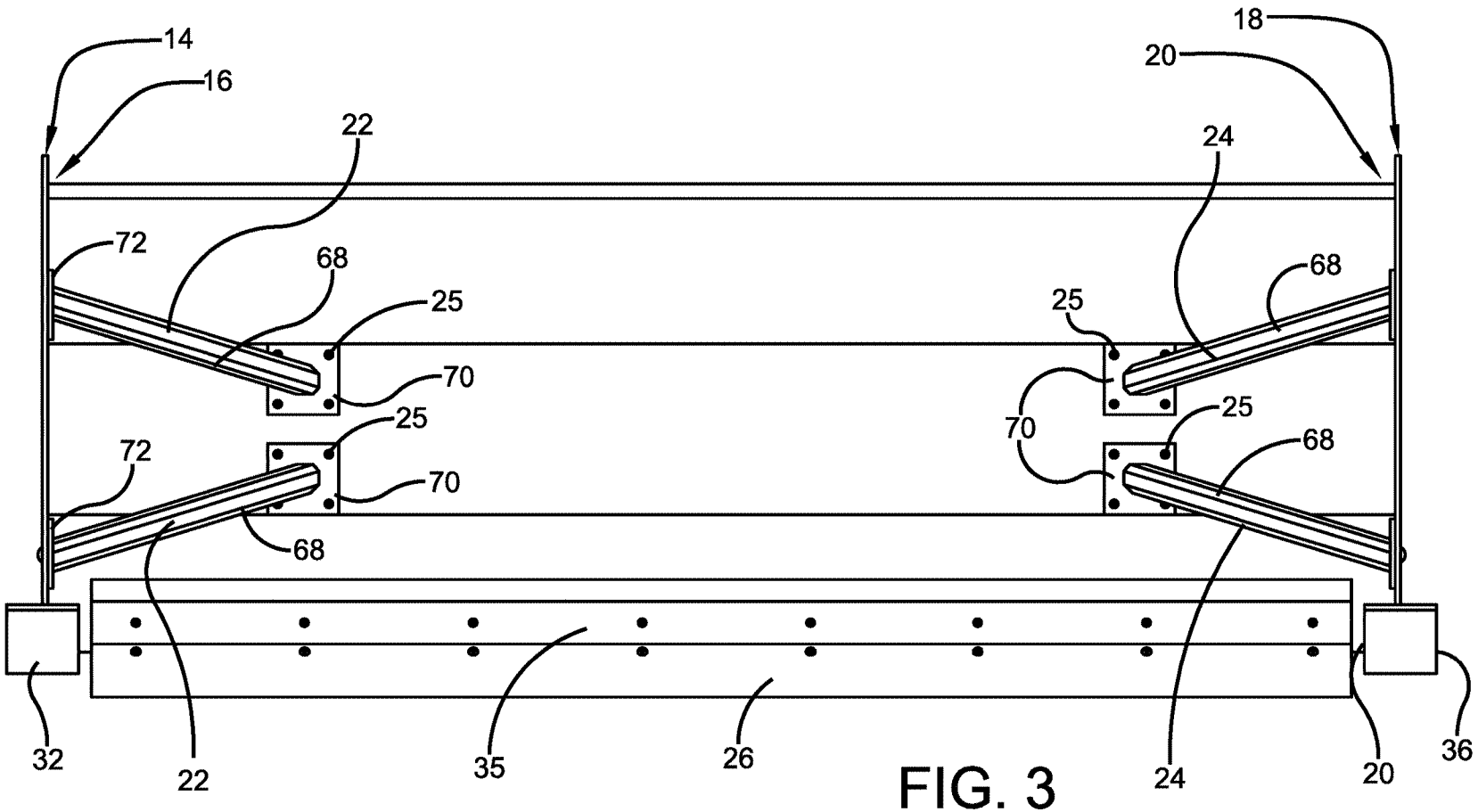
FIG. 3 is a front view of the plow of FIG. 1 showing the thrust arms, side plate and plow body of the plow.
Figure 4:
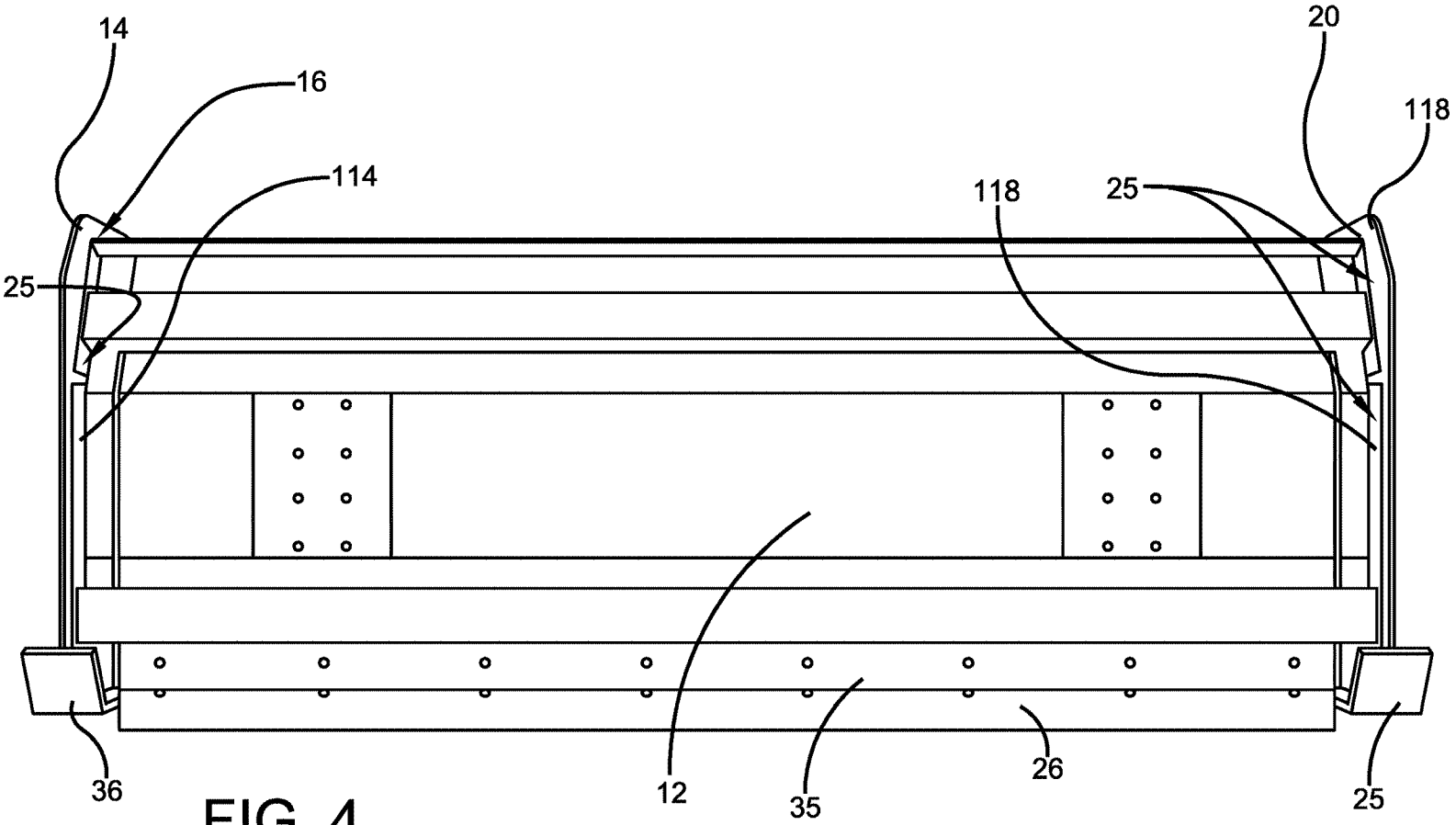
FIG. 4 is a rear view of the plow of FIG. 1.
Figure 5:
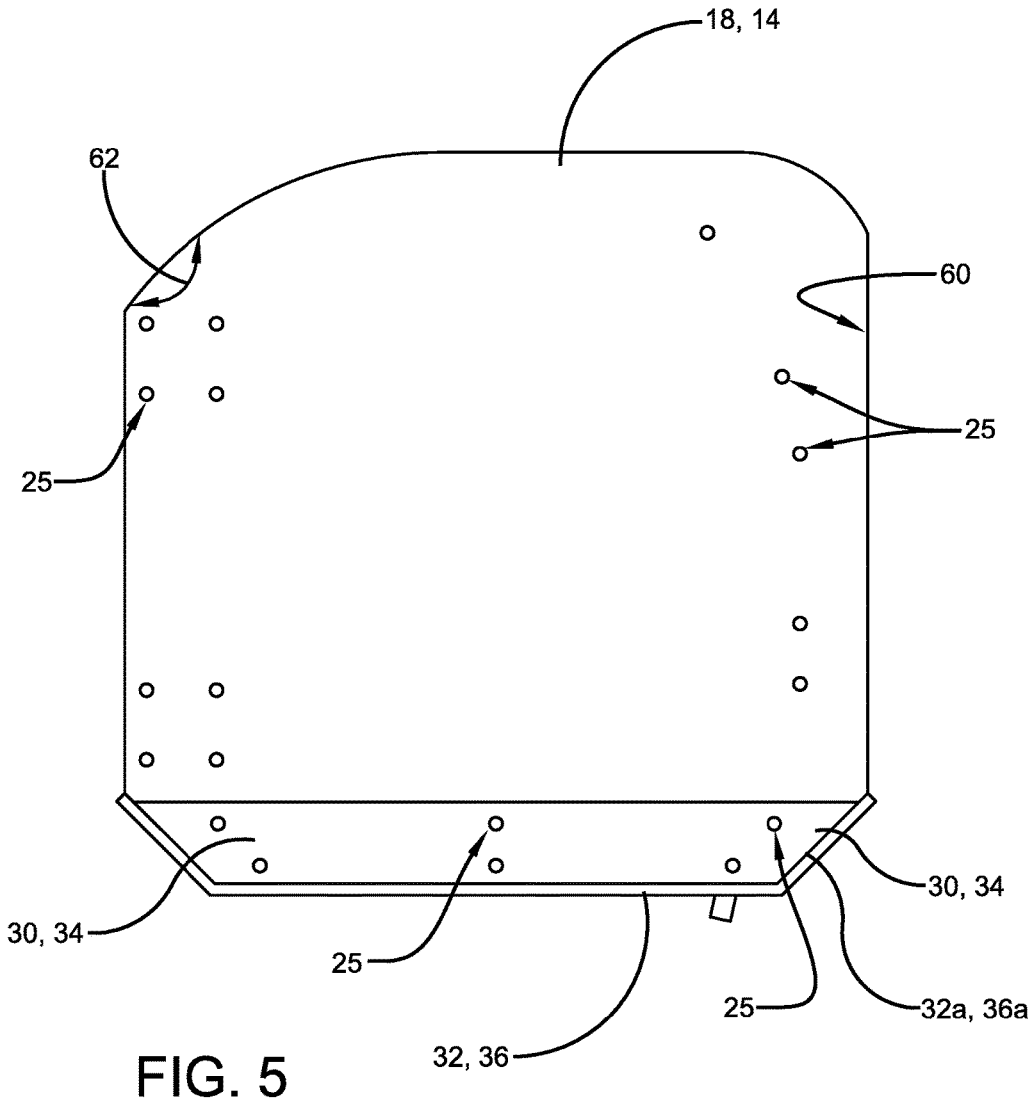
FIG. 5 is a side elevation view of the plow of FIG. 1.

As shown best in FIG. 2, attached to a rear side 38 of the plow body 12 is a mounting plate, shown schematically by X. The mounting plate X secures the plow 10 to a vehicle (not shown). The mounting plate X can be customized for mounting on a particular vehicle and is well-known in the art. The mounting plate 40 can be, but need not be, permanently affixed to the plow body 12, such as by welding. The mounting plate 40 is preferably made of steel, but can be made of any suitable material.

Figure 6:
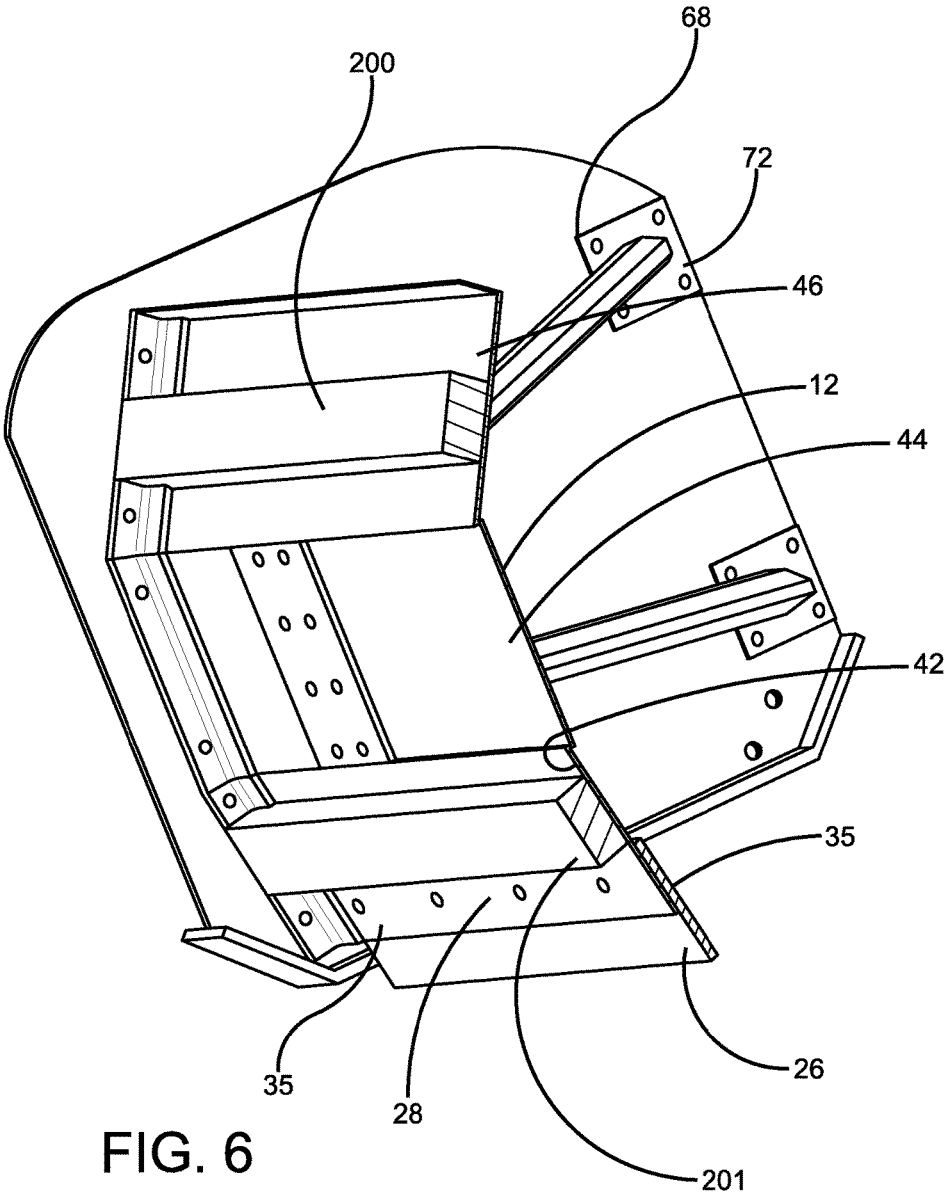
FIG. 6 is a sectional view along line 6-6 in FIG. 2.

As shown in FIG. 6, the blade 12 includes a first lower inwardly angled portion 42, a generally vertical portion 44, and a second upper inwardly angled portion 46. All portions 42,44,46, in combination form a scoop for use in collecting snow or dirt. The scoop can also be used for moving other materials, such as but not limited to, grain or dry media or water, etc. The plow body 12 also includes a plurality of bolt openings 48 along its bottom edge 28. The generally vertical portion 44 includes a plurality of bolt openings 56 placed to accommodate bolts 25 attaching the plates 70 connected to the first and second plates thrust arms 22,24 to the plow body 12 as will be described below.

As also seen in FIG. 2, horizontal parallel channel members 200,201 are welded to the rear of the blade 12 to specifically reinforce the blade and stabilize it. These can be C-channels, I-channels or box channels. As used herein, the channels can include any suitable cross-section that provides the required stiffness.

Turning back to FIG. 5, the first and second side plates 14,18 have similar constructions. Each has a plurality of bolt openings 25 along its respective bottom edge 30,34 to accommodate bolts 25 to attach the first and second runners 32,36 thereto. Along the rear edges 60 of the respective side plates 14,18 are a plurality of bolt openings 25 to accommodate bolts to attach the side plates 14,18 to the first and second sides 16,20 respectively of the plow body 12 using bolts 25. The side plates 14,18 also include a plurality of bolt openings 25 adjacent their front edge 62 to attach the plates 72 for first and second thrust arms 22,24 attached thereto.

The first and second thrust arms 22,24 are preferably mounted to the plow body 12 and first and second side plates 14,18 such that the bar portion 68 forms an angle a in the range of 30 to 60 degrees with the horizontal axis, with a preferred angle of approximately 45 degrees, and an angle b in the range of 8 to 16 degrees with the vertical axis, with a preferred angle of approximately 10 degrees, to ensure the strength and stability of the sectional plow 10 during use.

FIGS. 7-9 and 17-18 show a second embodiment of the present invention. In this embodiment the blade is extended on both sides with extension sections 310.

FIGS. 10-12 and 19-20 show a third embodiment of the present invention. In this embodiment the blade is extended on both sides with extension sections 320.

Figure 13:
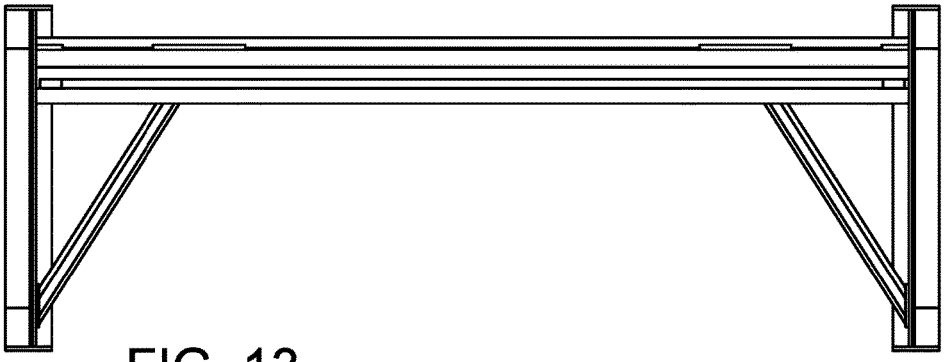
FIGS. 13 and 14 is a top plan view and front view of a fourth embodiment of the sectional plow of having a single thrust arm connecting the blade and side plates.
Figure 14:
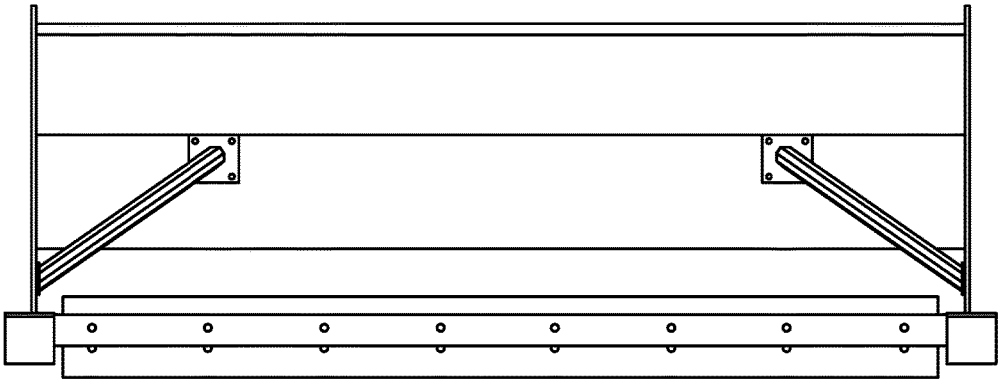
Figure 15:
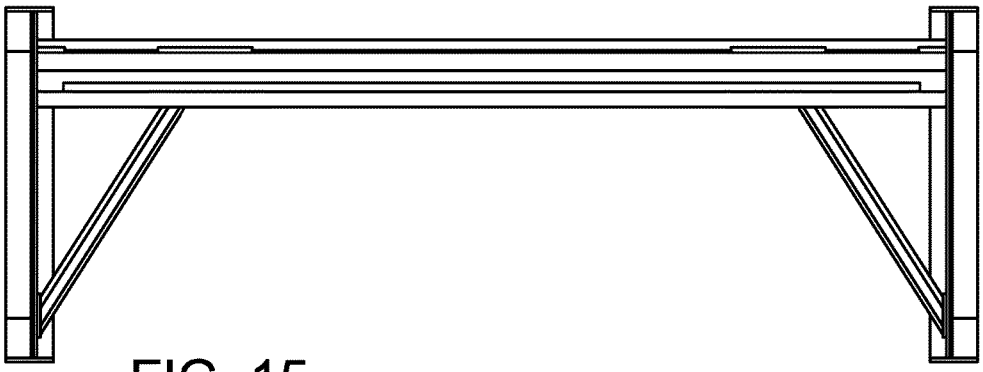
FIGS. 15 and 16 is a top plan view and front view of a plow of the first embodiment having a dual thrust arms connecting the blade and side plates.
Figure 16:
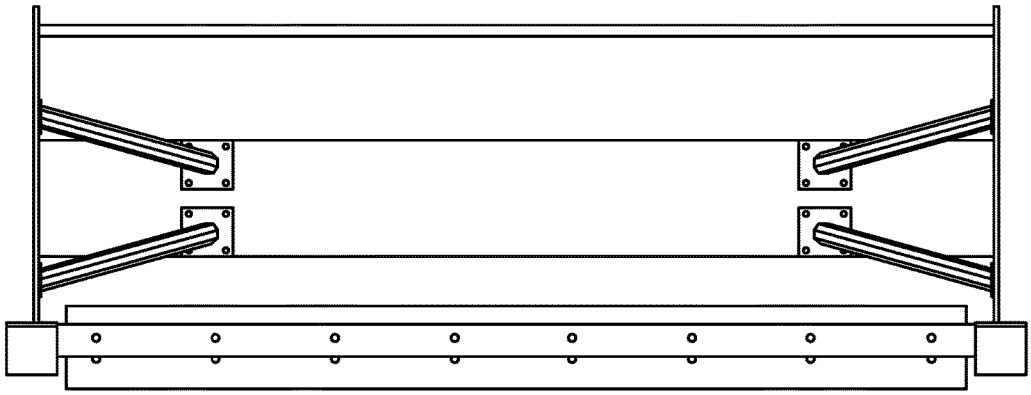
Figure 17:
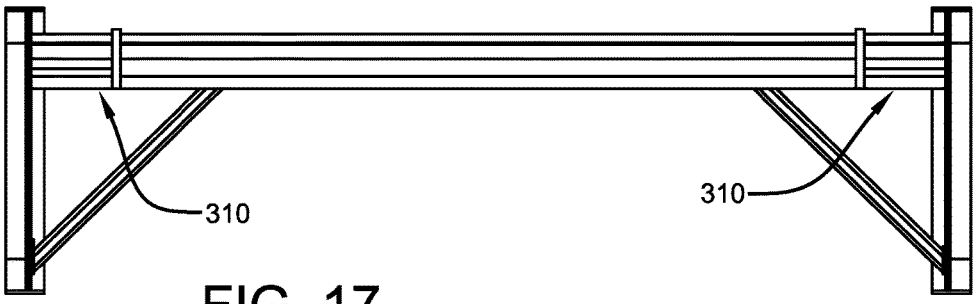
FIGS. 17 and 18 is a top plan view and front view of a plow of the second embodiment having a dual thrust arms connecting the blade and side plates; and, FIGS. 19 and 20 is a top plan view and front view of a plow of the third embodiment having a dual thrust arms connecting the blade and side plates.
Figure 18:
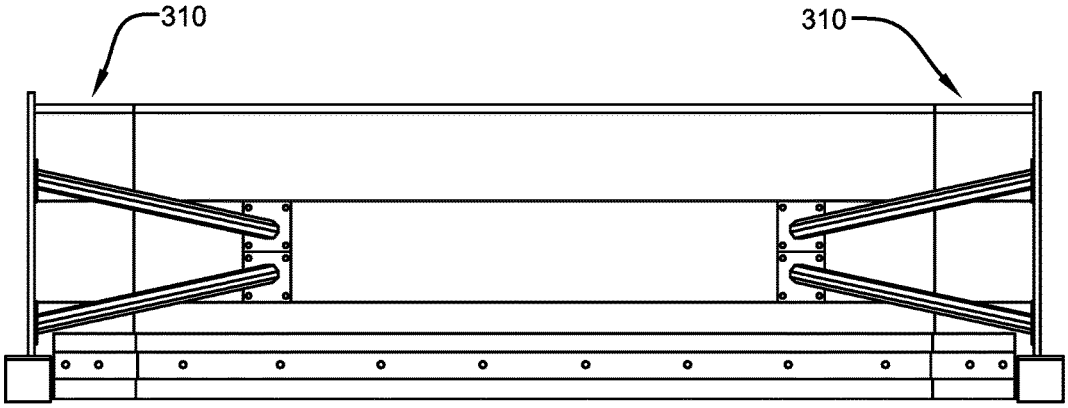
Figure 19:
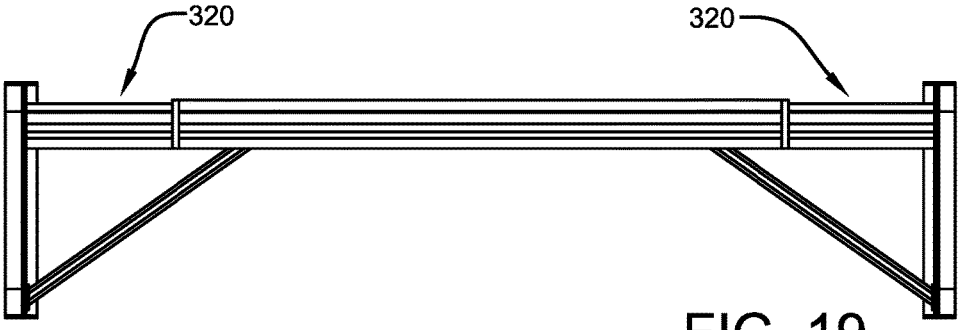
Figure 20:
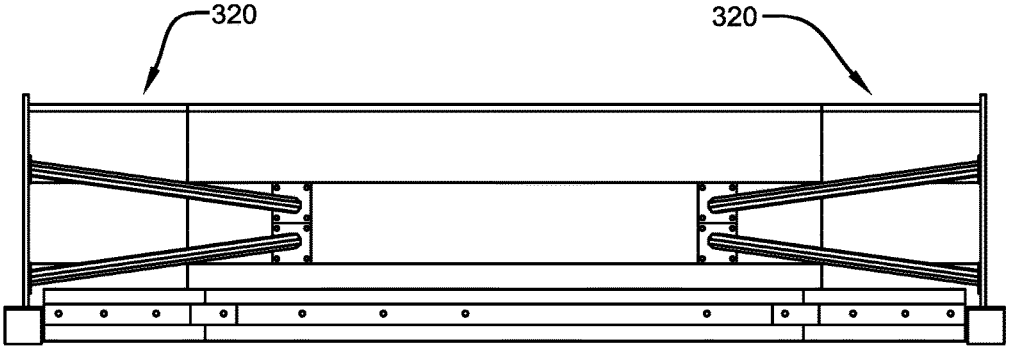

FIGS. 13-14 show a fourth embodiment of the present invention. In accordance with this embodiment, the plow 10 includes only one first thrust arm 22 and one second thrust arm 24.

The bolt openings in the parts are pre-bored so that the parts can be assembled and then easily bolted together. Standard high strength bolts have hexagonal bolt heads and nuts. In some locations, it is more advantageous to use carriage bolts with rounded, smooth heads. Such places include high impact areas, such as the face of the blade.

The following parts can be disassembled or shipped broken down:

the blade 12 (with support channels 201,201);

each strut (first struts 22 and second struts 24)(each with welded end plates 70,72);

each side piece (first side 14 and second side 18);

each runner (first runner 32 and second runner 36);

an elongated contact edge 26;

two elongated straight pieces of steel 35; and, bolts 25.

It is relatively easy to assemble the above parts together and assemble the parts for transport or storage. In addition, if something breaks, the piece can be relatively easy to replace with a new piece. Instead of extensive, time consuming repair work, the broken parts can be removed and replaced.

Figure 7:
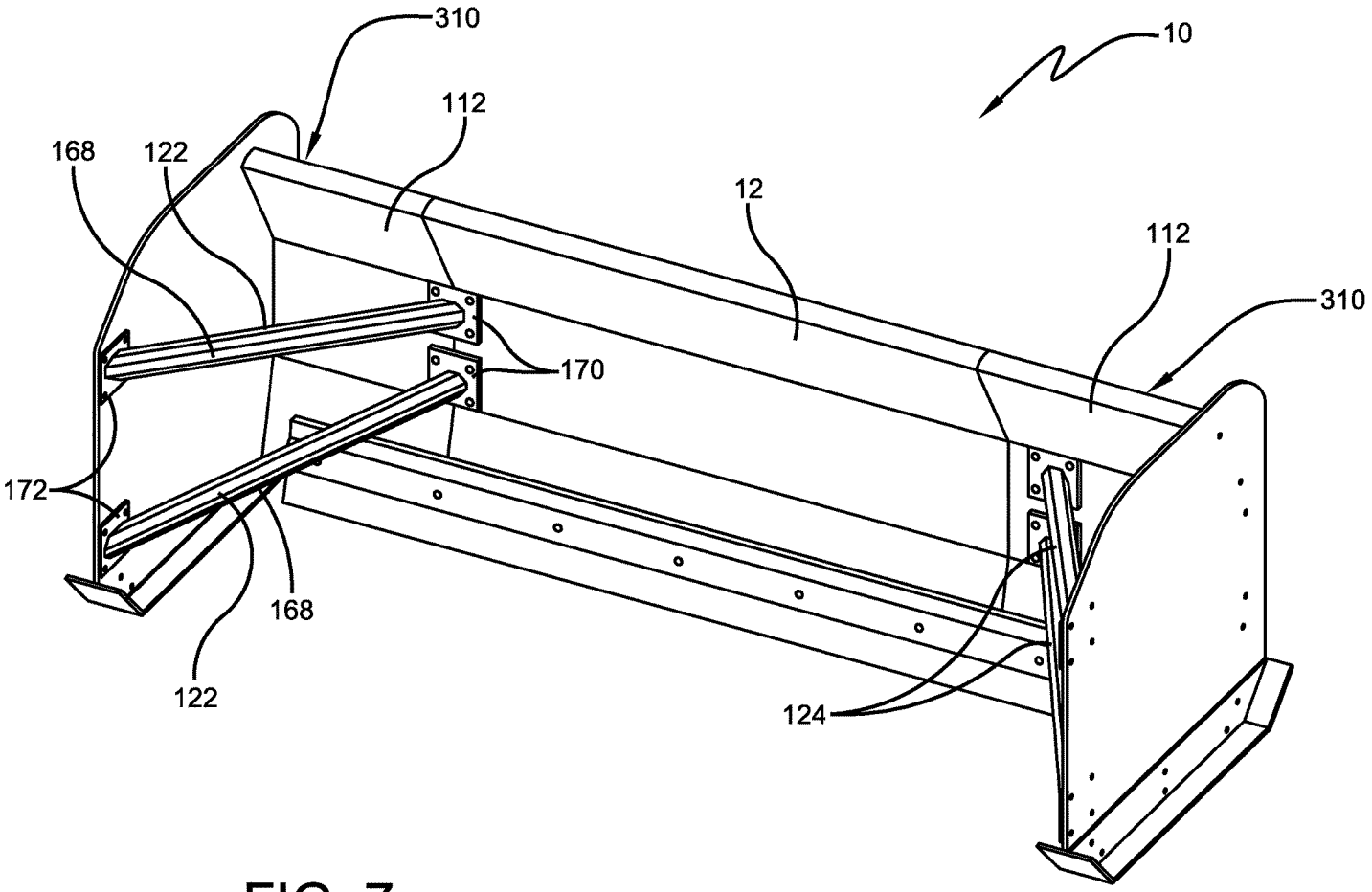
FIG. 7 is a front perspective view of a second embodiment of the sectional plow made in accordance with the teachings of the present invention.
Figure 8:
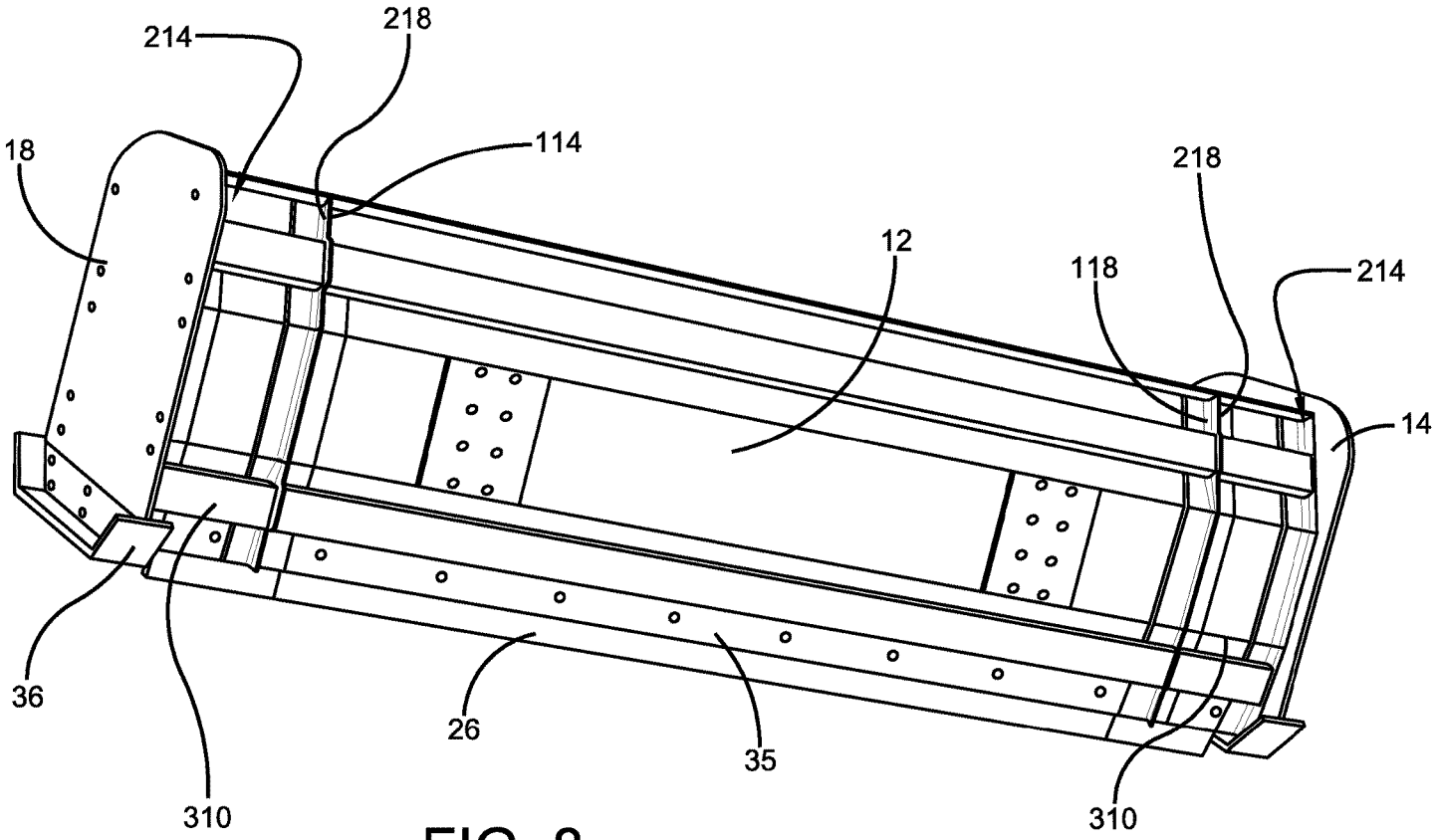
FIG. 8 is a rear perspective view the plow of FIG. 7.
Figure 9:
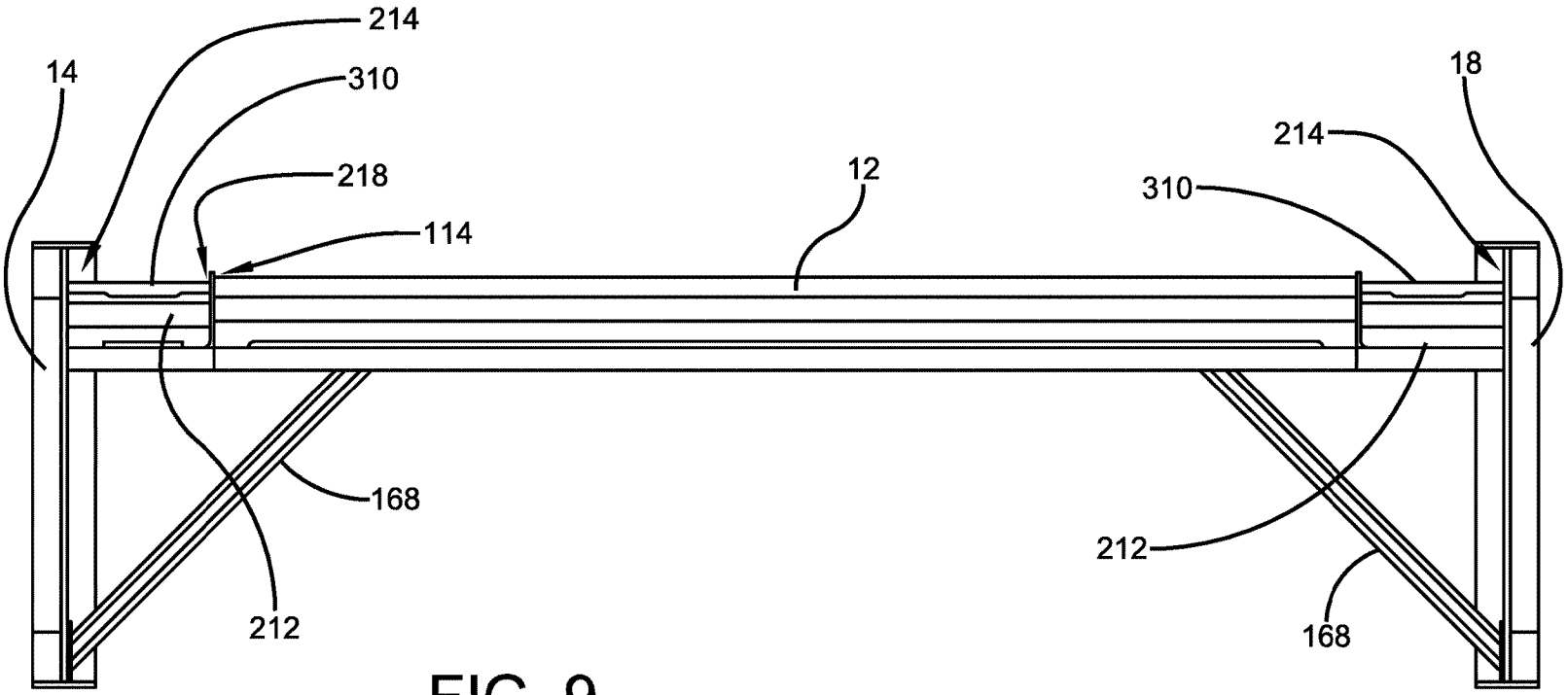
FIG. 9 is a top plan view of the plow of FIGS. 7 and 8.
Figure 10:
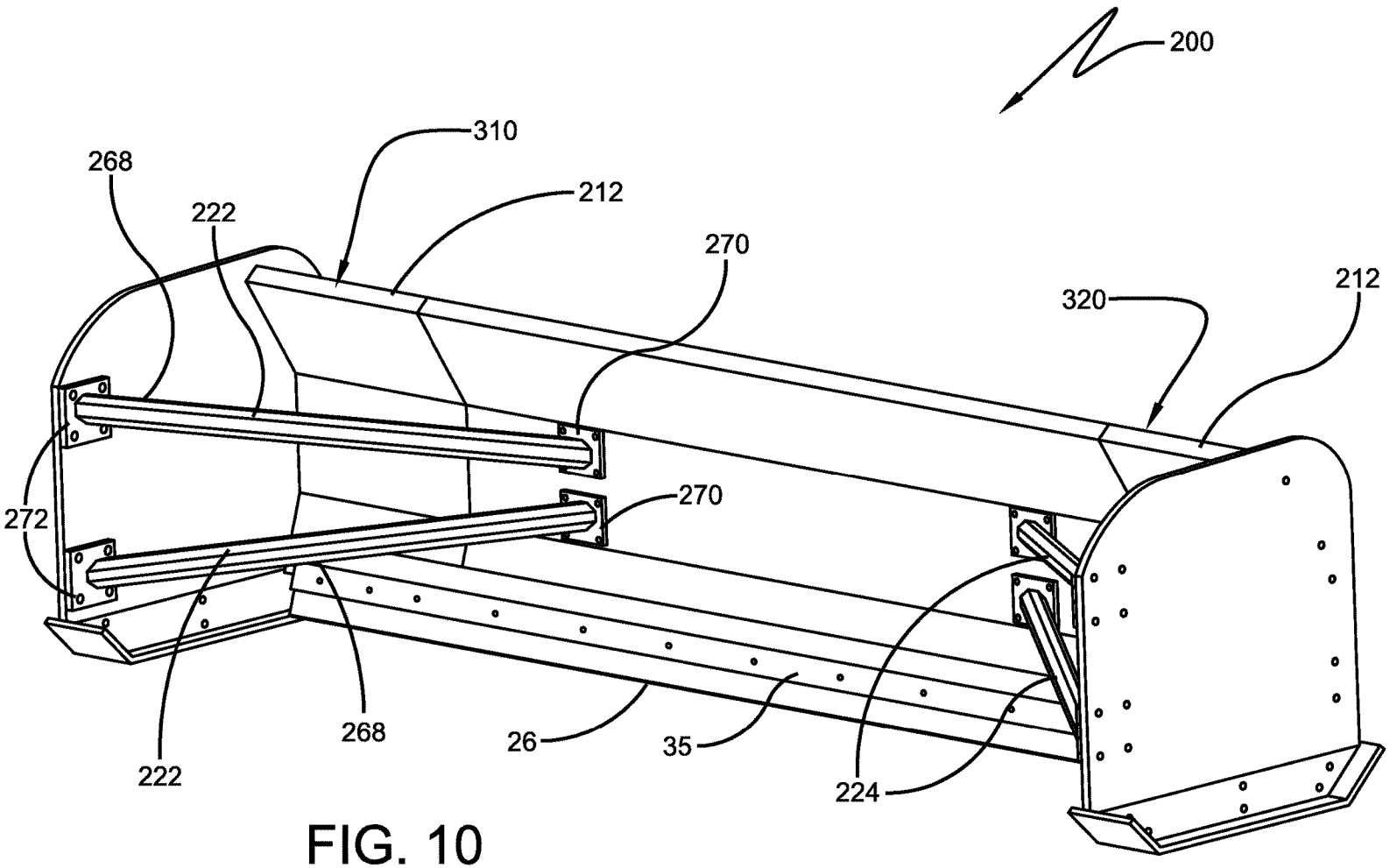
FIG. 10 is a front perspective view of a third embodiment of the sectional plow made in accordance with the teachings of the present invention.
Figure 11:
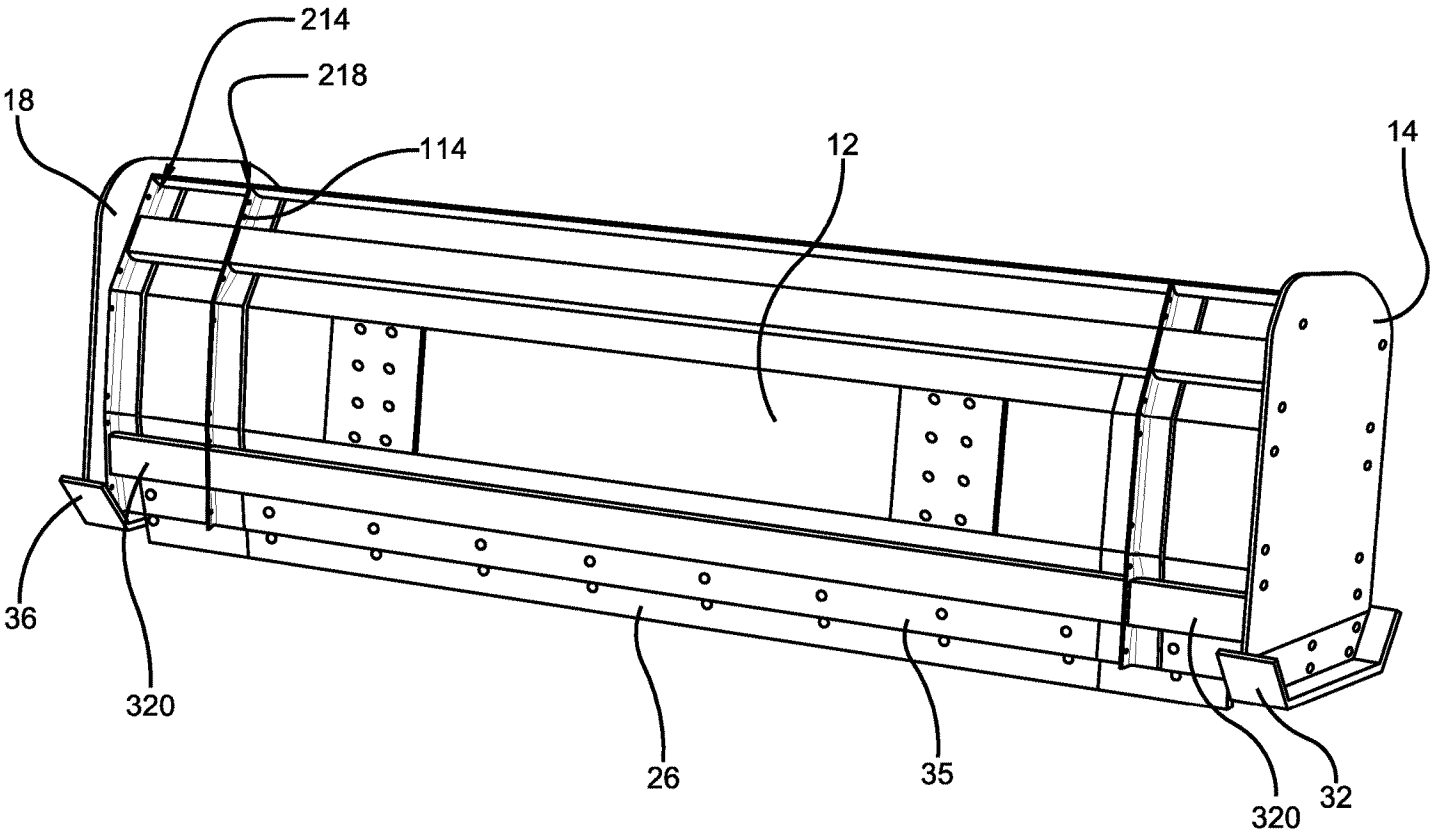
FIG. 11 is a rear perspective view the plow of FIG. 10.
Figure 12:
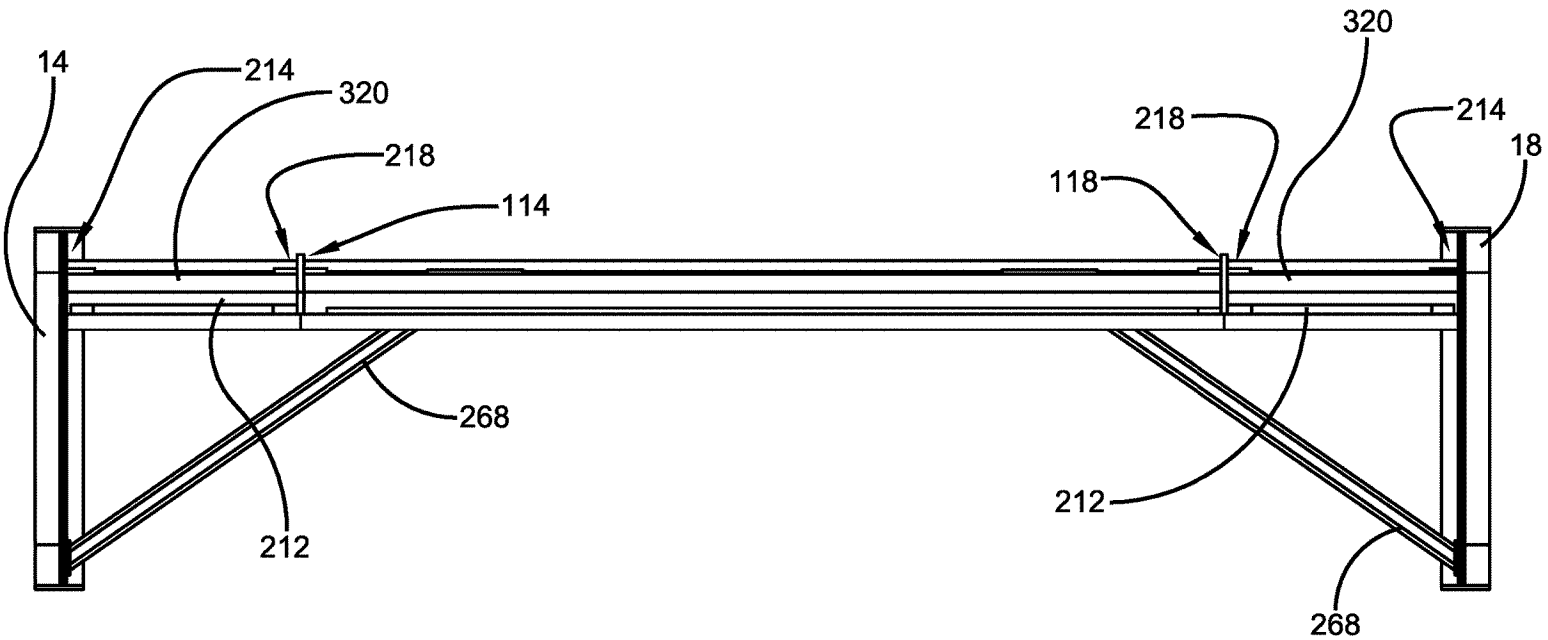
FIG. 12 is a top plan view of the plow of FIGS. 10 and 11.

The above descriptions relate to a plow having an approximate width of 8 feet. This standard width can be easily enlarged to 10 feet and or 12 feet, or other size as discussed above. To accomplish this, plow blade extensions can be added. In particular, extension sections 310 of one foot (as shown in the embodiment of FIGS. 7-9) or extension sections 320 of two feet (as shown in the embodiment of FIGS. 10-12) can be added to the original structure 10 to form plows of 10 feet (110) or twelve feet (120). The blades of each extension 112,212 are constructed with a structure to those of the center blade 12 (FIG. 6) having a first lower inwardly angled portion, a generally vertical portion, and a second upper inwardly angled portion with all the portions forming a scoop for collecting snow or dirt. Each of the extension blades 112,212 has flanges 214,218 integral to their sides, similar to construction to the flanges 14,18 of the center blade 12. Thus, the blade 12 can be unbolted to the side pieces along its flanges and those same flanges can be connected to the blade extension, which in turn can be connected along its free side along its respective flange to the side pieces. In short, the side pieces can be removed and an extension can be interposed between each side piece and the original blade to extend the width of the plow. The first and second sides 14,18 of the blade 12 include flanges 114,118.

As before, each plow 110,120 includes struts 122,124, 222,224 with each including a bar portion 168,268. Attached to a first end of the bar portion 168,268 is a first mounting plate 170,270 and attached to a second, opposite end of the bar portion is a second mounting plate 172,272. The plates 170,270,72,172,272 include a plurality of bolt openings 25 with aligned bolt openings in the blade and side members. The strut angles are preferably those discussed above with respect to FIG. 1.

Accordingly, to convert the 8' plow 10 to a 10 or 12 foot plow, one removes the side members 14,18 and struts 22,24, inserts and attaches the two extensions (310 or 320) between the side members 14,18 and the blade 12 and then connects the appropriate new struts (122,124 or 222,224) contact edge 26 and bottom edge 34 of the blade 12 can be sandwiched between two elongated straight pieces of steel 35 with bolts going through the pieces of steel and the bottom edge and contact edge disposed therebetween. In the alternative, the contact edge 26 can be sandwiched between a single elongated piece of steel 35 and the blade 12.

Accordingly, both assembling the plow and disassembling the plow can be performed relatively quickly with minimal tools and in relatively little time. The disassembled plow can be stowed, stored, or shipped in a relatively small space or package. For example, the blade can be used as the shell and the struts, side pieces, runners, elongated contact edge, extensions, alternative struts, and bolts can be stored under or within the frame of the blade for storing. The blade can them be wrapped and shipped at a lower freight rate.

While the specific embodiments have been illustrated and described, numerous modifications come to mind without significantly departing from the spirit of the invention, and the scope of protection is only limited by the scope of the accompanying Claims.

What is claimed is:

1. A sectional plow assembly comprising:

a plow body, the plow body having a first plurality of openings for receiving removable fasteners;

a first side plate removably and fixedly attached by removable fasteners to a first side of the plow body or to a second side of a first extension which is removably and fixedly attached to the plow body, the first side plate having a second plurality of openings for receiving the removable fasteners;

a second side plate removably and fixedly attached by removable fasteners to a second opposite side of the plow body or to a second side of a second extension which is removably and fixedly attached to the plow body, the second side plate having a third plurality of openings for receiving the removable fasteners;

a first thrust arm removably attached to the plow body and the first side plate by the removable fasteners, the first thrust arm including a first bar portion and first and second mounting plates attached to opposite ends of the first bar portion, the first and second mounting plates including a plurality of openings, the plurality of openings of the first mounting plate being aligned with the first plurality of openings, and the plurality of openings of the second mounting plate being aligned with the second plurality of openings;

a second thrust arm removably attached to the plow body and the second side plate by the removable fasteners, the second thrust arm including a second bar portion and third and fourth mounting plates attached to opposite ends of the second bar portion, the third and fourth mounting plates including a plurality of openings, the plurality of openings of the third mounting plate being aligned with the first plurality of openings, and the plurality of openings of the fourth mounting plate being aligned with the third plurality of openings;

wherein at least one of the first removable extension and the second removable extension is disposed between the plow body and the first side plate and between the plow body and the second side plate, wherein each extension is connected to the plow body and the first side plate or to the plow body and the second side plate by a removable fastener, wherein the plow body includes a first side flange and a second side flange and each of the extensions include a first side flange and a second side flange, wherein the first side flange and the second side flange of the plow body and the first side flange and the second side flange of the first and second removable extensions are substantially similar in structure to allow for alignment and connection of the flanges, wherein the removable fasteners include bolts and each of the first side flange and second side flange of the plow body and the first side flange and second side flange of each of the extensions are pre-bored to receive the bolts, wherein at least one of the following connections is established: i) the first side flange of the plow body is connected to the first side flange of the first extension and ii) the second side flange of the plow body is connected to the first side flange of the second extension; and wherein one of the following connections is established: i) the second side flange of the first extension is connected to the first side plate and the second side flange of the second extension is connected to the second side plate, ii) the second side flange of the first extension is connected to the first side plate and the second side flange of the plow body is connected to the second side plate, or iii) the first side flange of the plow body is connected to the first side plate and the second side flange of the second extension is connected to the second side plate; and a contact edge which is sandwiched between two elongated straight pieces of steel or between a single elongated straight piece of steel and the plow body which extends along the length of the plow body and at least one of the first and second extensions.

2. The plow assembly of claim 1 further comprising a first runner removably attached along a bottom edge of the first side plate, and a second runner removably attached along a bottom edge of the second side plate.

3. The plow assembly of claim 1 further comprising a first wear surface removably attached along a bottom edge of the first side plate, and a second wear surface removably attached along a bottom edge of the second side plate.

4. The plow assembly of claim 1 wherein the first and second thrust arms are attached to the plow body and first and second side plates at an angle in the range of 30 to 60 degrees along a horizontal axis, and an angle in the range of 8 to 16 degrees along a vertical axis.

5. The plow assembly of claim 1 wherein the removable fasteners for removably attaching the first side plate, second side plate, first thrust arm and second thrust arm to the plow comprise nuts and bolts, and wherein each of the first, second, and third plurality of openings are pre-bored to receive the nuts and bolts.

6. The plow assembly of claim 1, wherein the plow body has a generally concave interior surface, the first and second side plates and the first and second thrust arms being removably attached to the interior surface.

7. The plow assembly of claim 1, further comprising:

a third thrust arm removably attached to the plow body and the first side plate by the removable fasteners; and a fourth thrust arm removably attached to the plow body and the second side plate by the removable fasteners.

8. The plow assembly of claim 7, wherein the third thrust arm includes a third bar portion and fifth and sixth mounting plates attached to opposite ends of the third bar portion, the fifth and sixth mounting plates including a plurality of openings, the plurality of openings of the fifth mounting plate being aligned with the first plurality of openings, and the plurality of openings of the sixth mounting plate being aligned with the second plurality of openings, and the fourth thrust arm includes a fourth bar portion and seventh and eighth mounting plates attached to opposite ends of the fourth bar portion, the seventh and eighth mounting plates including a plurality of openings, the plurality of openings of the seventh mounting plate being aligned with the first plurality of openings, and the plurality of openings of the eighth mounting plate being aligned with the third plurality of openings.

9. The plow assembly of claim 1, wherein a pair of horizontal parallel channel members which are welded to the rear of the plow body to reinforce the plow body and stabilize it.

10. A plow that can be assembled and disassembled by removable fasteners comprising:

a blade having a first plurality of openings;

a first extension which is removably and fixedly attached to the blade;

a second extension which is removably and fixedly attached to the blade;

a contact edge which is sandwiched between two elongated straight pieces of steel or between a single elongated straight piece of steel and the blade which extends along the length of the blade;

first and second side members having a respective second and third plurality of openings, each side member being positioned at a side of the blade, each side member being removably and fixedly connected to the blade, to the first extension or to the second extension by the removable fasteners;

a first strut removably connected to the blade and the first side member by the removable fasteners, the first strut reinforcing the first side member and the blade, the first strut including a first bar portion and first and second mounting plates attached to opposite ends of the first bar portion, the first and second mounting plates including a plurality of openings, the plurality of openings of the first mounting plate being aligned with the first plurality of openings, and the plurality of openings of the second mounting plate being aligned with the second plurality of openings;

a second strut removably connected to the blade and the second side member by the removable fasteners, the second strut reinforcing the second side member and the blade, the second strut including a second bar portion and third and fourth mounting plates attached to opposite ends of the second bar portion, the third and fourth mounting plates including a plurality of openings, the plurality of openings of the third mounting plate being aligned with the first plurality of openings, and the plurality of openings of the fourth mounting plate being aligned with the third plurality of openings;

wherein at least one of the first removable extension and the second removable extension is disposed between the blade and the first side member and between the blade and the second side member, wherein each extension is connected to the blade and the first side member or to the blade and the second side member by a removable fastener, wherein the blade includes a first side flange and a second side flange and each of the extensions include a first side flange and a second side flange, wherein the first side flange and the second side flange of the blade and the first side flange and the second side flange of the first and second removable extensions are substantially similar in structure to allow for alignment and connection of the flanges, wherein the removable fasteners include bolts and each of the first side flange and second side flange of the blade and the first side flange and second side flange of each of the extensions are pre-bored to receive the bolts, wherein at least one of the following connections is established: i) the first side flange of the blade is connected to the first side flange of the first extension and ii) the second side flange of the blade is connected to the first side flange of the second extension; and wherein one of the following connections is established: i) the second side flange of the first extension is connected to the first side member and the second side flange of the second extension is connected to the second side member, ii) the second side flange of the first extension is connected to the first side member and the second side flange of the blade is connected to the second side member, or iii) the first side flange of the blade is connected to the first side member and the second side flange of the second extension is connected to the second side member; and a replacement first strut and a replacement second strut which respectively replace the first strut and the second strut upon insertion of at least one of the first removable extension and the second removable extension, wherein the replacement first strut and the replacement second strut are greater in length than the first strut and the second strut; and, a replacement contact edge which is sandwiched between two replacement elongated straight pieces of steel or between a single replacement elongated straight piece of steel and the blade which extends along the length of the blade and the extensions.

11. The plow of claim 10 further including:

a runner below each side member.

12. The plow of claim 10 further including:

a wear surface below each side member.

13. The plow of claim 10 wherein the removable fasteners are bolts and nuts used to assemble and disassemble the plow.

14. The plow of claim 10, further comprising:

a third strut removably connected to the blade and the first side member by the removable fasteners; and a fourth strut removably connected to the blade and the second side member by the removable fasteners.

15. The plow of claim 14, further comprising:

the third strut reinforcing the first side member and the blade, the third strut including a third bar portion and fifth and sixth mounting plates attached to opposite ends of the third bar portion, the fifth and sixth mounting plates including a plurality of openings, the plurality of openings of the fifth mounting plate being aligned with the first plurality of openings, and the plurality of openings of the sixth mounting plate being aligned with the second plurality of openings, and the fourth strut reinforcing the second side member and the blade, the fourth strut including a fourth bar portion and seventh and eighth mounting plates attached to opposite ends of the fourth bar portion, the seventh and eighth mounting plates including a plurality of openings, the plurality of openings of the seventh mounting plate being aligned with the first plurality of openings, and the plurality of openings of the eighth mounting plate being aligned with the third plurality of openings.

16. The plow of claim 10, further comprising a pair of horizontal parallel channel members which are welded to the rear of the blade to reinforce the blade and stabilize it.

17. A kit of components for assembling a sectional plow, the kit comprising:

a plurality of removable fasteners;

a plow body having a first plurality of openings for receiving a respective one of the plurality of removable fasteners;

a first extension which is removably and fixedly attached to the plow body;

a second extension which is removably and fixedly attached to the plow body;

a contact edge which is sandwiched between two elongated straight pieces of steel or between a single elongated straight piece of steel and the plow body which extends along the length of the body and the extensions;

a first side plate having a second plurality of openings for receiving a respective one of the plurality of removable fasteners;

a second side plate having a third plurality of openings for receiving a respective one of the plurality of removable fasteners;

first and second thrust arms, each of the first and second thrust arms having a respective first and second mounting plate attached thereto, each of the first and second mounting plates including a plurality of openings, the plurality of openings of the first mounting plates configured to align with the first plurality of openings, and the plurality of openings of the second mounting plates being aligned with the second plurality of openings; and third and fourth thrust arms, each of the third and fourth thrust arms having a respective third and fourth mounting plate attached thereto, each of the third and fourth mounting plates including a plurality of openings, the plurality of openings of the third mounting plates configured to align with the first plurality of openings, and the plurality of openings of the fourth mounting plates being aligned with the third plurality of openings, wherein at least one of the first removable extension and the second removable extension is disposed between the plow body and the first side plate and between the plow body and the second side plate, wherein each extension is connected to the plow body and the first side plate or to the plow body and the second side plate by a removable fastener, wherein the plow body includes a first side flange and a second side flange and each of the extensions include a first side flange and a second side flange, wherein the first side flange and the second side flange of the plow body and the first side flange and the second side flange of the first and second removable extensions are substantially similar in structure to allow for alignment and connection of the flanges, wherein the removable fasteners include bolts and each of the first side flange and second side flange of the plow body and the first side flange and second side flange of each of the extensions are pre-bored to receive the bolts, wherein at least one of the following connections is established: i) the first side flange of the plow body is connected to the first side flange of the first extension and ii) the second side flange of the plow body is connected to the first side flange of the second extension; and wherein one of the following connections is established: i) the second side flange of the first extension is connected to the first side plate and the second side flange of the second extension is connected to the second side plate, ii) the second side flange of the first extension is connected to the first side plate and the second side flange of the plow body is connected to the second side plate, or iii) the first side flange of the plow body is connected to the first side plate and the second side flange of the second extension is connected to the second side plate; and a replacement first thrust arm and a replacement second thrust arm which respectively replace the first thrust arm and the second thrust arm upon insertion of at least one of the first removable extension and the second removable extension, wherein the replacement first thrust arm and the replacement second thrust arm are greater in length than the first thrust arm and the second thrust arm; and, a replacement contact edge which is sandwiched between two replacement elongated straight pieces of steel or between a single replacement elongated straight piece of steel and the blade which extends along the length of the blade and the extensions.

* * * * *